US005533316A

United States Patent [19]

Hornsby

[11] Patent Number: 5,533,316

[45] Date of Patent: Jul. 9, 1996

[54] APPARATUS FOR COMPRESSING AND POSITIONING THE SEALING COMPONENTS OF AN OPEN HEAD DRUM

[75] Inventor: Gary L. Hornsby, Pinson, Ala.

[73] Assignee: Self Industries, Inc., Birmingham, Ala.

[21] Appl. No.: 434,784

[22] Filed: May 4, 1995

[51] Int. Cl.[6] ..... B65B 7/28; B65B 51/04

[52] U.S. Cl. ..... 53/137.2; 53/138.1; 53/306; 53/329

[58] Field of Search ..... 53/285, 287, 291, 53/302, 306, 329, 128.1, 129.1, 130.1, 137.1, 137.2, 138.1, 330, 333, 343

[56] References Cited

U.S. PATENT DOCUMENTS

| | | | |
|---|---|---|---|
| 24,779 | 7/1859 | Law . | |
| 31,689 | 3/1869 | Holmes . | |
| 1,133,701 | 3/1915 | Bennett . | |
| 1,263,768 | 4/1918 | Mehring . | |
| 2,555,194 | 5/1951 | Kojan et al. | 53/329 X |
| 2,862,340 | 12/1958 | Rauli | 53/287 |
| 3,886,711 | 6/1975 | Brothers et al. | 53/138.1 X |
| 4,646,931 | 3/1987 | Andrews et al. . | |
| 4,982,864 | 1/1991 | Kusta . | |
| 4,998,643 | 3/1991 | Pradel . | |
| 5,048,259 | 9/1991 | Cox et al. | 53/306 X |
| 5,092,488 | 3/1992 | Pradel . | |

*Primary Examiner*—Horace M. Culver
*Attorney, Agent, or Firm*—Veal & Marsh

[57] ABSTRACT

A press plate, actuated by a cylinder, has a press ring affixed to its lower surface. The press ring is dimensioned to fit on the lid of an open head drum. Magnets positioned on the lower surface of the press plate hold a split closing ring in position encircling the press ring. Horizontally actuated closing ring expanders are pivotally mounted in a plurality of slots spaced about the circumference of the press ring. A plurality of pins, positioned above the split closing ring, extend through the press plate. A plurality of clamp levers, having bottom ends positioned below the press plate and externally of the split closing ring and upper ends connected to actuators mounted on top of the press plate, are pivotally mounted to and extend through the press plate. A split closing ring encircling the press ring is urged outwardly by the ring expanders as the press plate and press ring move downward, compressing a sealing gasket between the lid and drum. The pins positioned over the split closing ring are sequentially actuated, first along one side of the split closing ring, and then along the other, to extend downwardly, pushing the split closing ring away from the magnet and into position at the juncture between the lid and drum. The clamp levers are then actuated to compress the split closing ring against the drum and lid.

31 Claims, 8 Drawing Sheets

APPARATUS FOR COMPRESSING AND POSITIONING THE SEALING COMPONENTS OF AN OPEN HEAD DRUM

FIELD OF THE INVENTION

The present invention relates to the field of shipping and storage containers, and more specifically to open head drums. The lid of an open head drum is secured to the drum with a split closing ring, and is sealed by means of a gasket placed between the drum and the lid. The present invention particularly relates to an apparatus for compressing the gasket and properly positioning the split closing ring on the drum for sealing.

BACKGROUND OF THE INVENTION

Open head drums are commonly used as storage and transportation containers in many industries. An open head drum typically has an outwardly rolled upper rim, upon which a compressible gasket is placed. A lid, with an annular mating groove dimensioned to fit over the rolled rim of the drum, is placed on top of the gasket. After the gasket is compressed, the lid is held in place by a split closing ring, the ends of which are fastened together with a bolt or lever locking mechanism. In order to maintain the sealing pressure on the gasket, the split closing ring must be dimensioned to fit tightly against the perimeter of the lid and rim.

Present methods of placing the split closing ring include placing it manually in position at the juncture between the lid and drum. Manually placing the closing ring is a relatively slow process, and is accordingly not well-suited for a conveyor processing line operation in which the drums typically arrive at the sealing area at the rate of one drum every 6 seconds. In such operations, it is usually necessary to have more than one worker positioning the split closing ring. Additionally, manual placement of the closing ring entails some risk of injury to the hands of the worker. Further, as the drum is conveyed downstream to the next work station for compression of the sealing gasket and fastening of the closing ring, the closing ring is prone to slipping out of position. Because the combined height of the rolled rim, uncompressed gasket and lid exceeds the cross-sectional height of the split closing ring, the closing ring cannot properly grasp the lid and rim of the drum until the gasket is compressed. Therefore, after manual placement of the split closing ring, the closing ring lies adjacent to the juncture between the lid and the drum, but is not properly seated in position. As the drum travels down the conveyor, the attendant vibrations often cause the closing ring to slip below or above the proper position.

An apparatus for automating split closing ring placement is known in the field. That apparatus, like the apparatus of the present invention, uses magnets to hold a split closing ring in position above an open head drum. Upon activation, the apparatus expands the closing ring and presses the lid downwardly to compress the gasket. A plurality of pins positioned above the split closing ring then push downwardly simultaneously on the closing ring, urging it into position around the lid and drum. A major drawback of the apparatus is that because the expanded split closing ring is pushed down all at once, it has a tendency to overshoot the juncture between the lid and drum. When the closing ring overshoots the proper position, workers must manually reposition the closing ring. A drawback of either of the above methods for placing the split closing ring is that neither provides means for pressing the split closing ring against the juncture for fastening; the only means for tightening the closing ring against the juncture is tightening of the bolt at the ends of the closing ring.

SUMMARY OF THE PRESENT INVENTION

With the foregoing in mind, the principal object of the present invention is to provide an apparatus which automates the process of positioning the split closing ring accurately at the juncture between the lid and the drum.

Another object of the invention is to provide an apparatus which urges the lid downwardly, compressing the sealing gasket, prior to placement of the split closing ring.

Yet another object of the invention is to provide an apparatus which compresses the split closing ring against the juncture between the lid and drum to facilitate fastening of the ends of the split closing ring.

These and other objects of the present invention are accomplished through the use of a number of components mounted on a press plate. The press plate is mounted for vertical movement and is preferably actuated by a pneumatic cylinder. A press ring, affixed to the bottom of the press plate is dimensioned to fit on the drum lid, just inside of the mating groove. One or more magnets are positioned on the bottom of the press plate to hold a split closing ring in position encircling the press ring. The press ring has a plurality of slots spaced about its circumference, in which horizontally actuated ring expanders are pivotally mounted. A plurality of pins, positioned along a circle above the position of the split closing ring, extend through the press plate. A plurality of clamp levers, having their bottom ends positioned below the press plate and externally of the split closing ring and their upper ends connected to actuators mounted on top of the press plate, are pivotally mounted to and extend through the press plate. In operation, a split closing ring is placed in position encircling the press ring. As the press plate moves downward, the press ring engages the top of the lid and presses it against the gasket and drum. At the same time, the ring expanders push outwardly through the slots in the press ring, expanding the split closing ring. The pins positioned over one side of the split closing ring are actuated to extend downwardly, pushing the split closing ring away from the magnet and into position at the juncture between the lid and drum. The pins positioned over the other side of the split closing ring are actuated after, but closely following, actuation of the first group of pins. After the split closing ring is positioned, the clamp levers are actuated to compress the split closing ring against the drum and lid, drawing the ends of the split closing ring toward each other.

BRIEF DESCRIPTION OF THE DRAWINGS

The foregoing objects and advantages of the present invention for an apparatus for compressing and positioning the sealing components of an open head drum will be more readily understood by one skilled in the art by referring to the following detailed description of a preferred embodiment and to the accompanying drawings which form a part of this disclosure and wherein.

DETAILED DESCRIPTION OF THE PREFERRED EMBODIMENT

Figure 1:
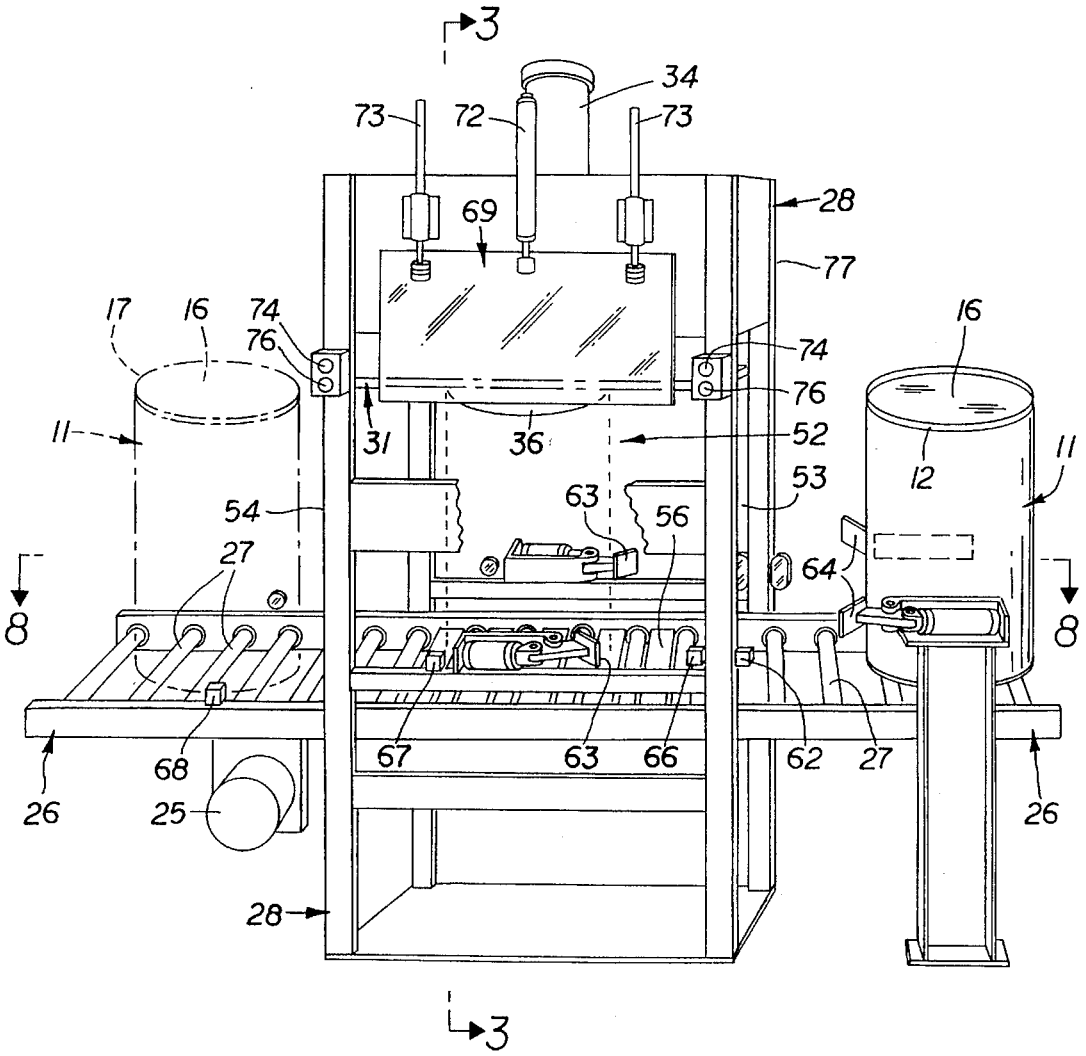
FIG. 1 is a front perspective view of the apparatus.
Figure 2:
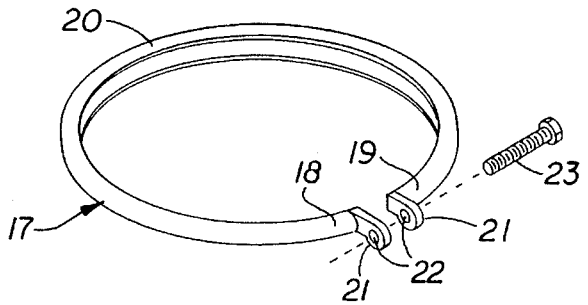
FIG. 2 is a perspective view of a split closing ring.
Figure 3:
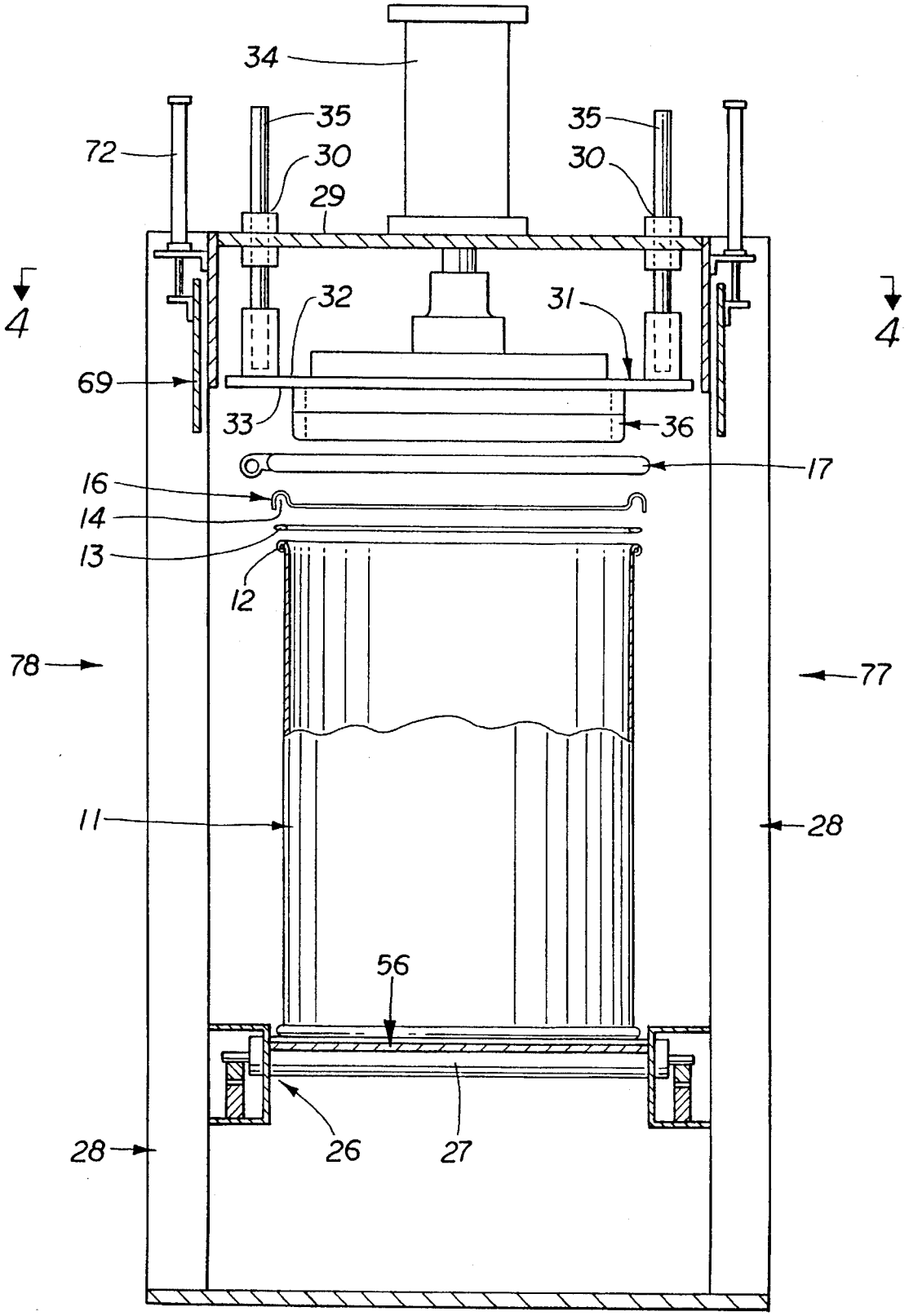
FIG. 3 is a sectional view of the apparatus showing the drum, sealing components, lid and press plate, taken along line 3—3 of FIG. 1.
Figure 11:
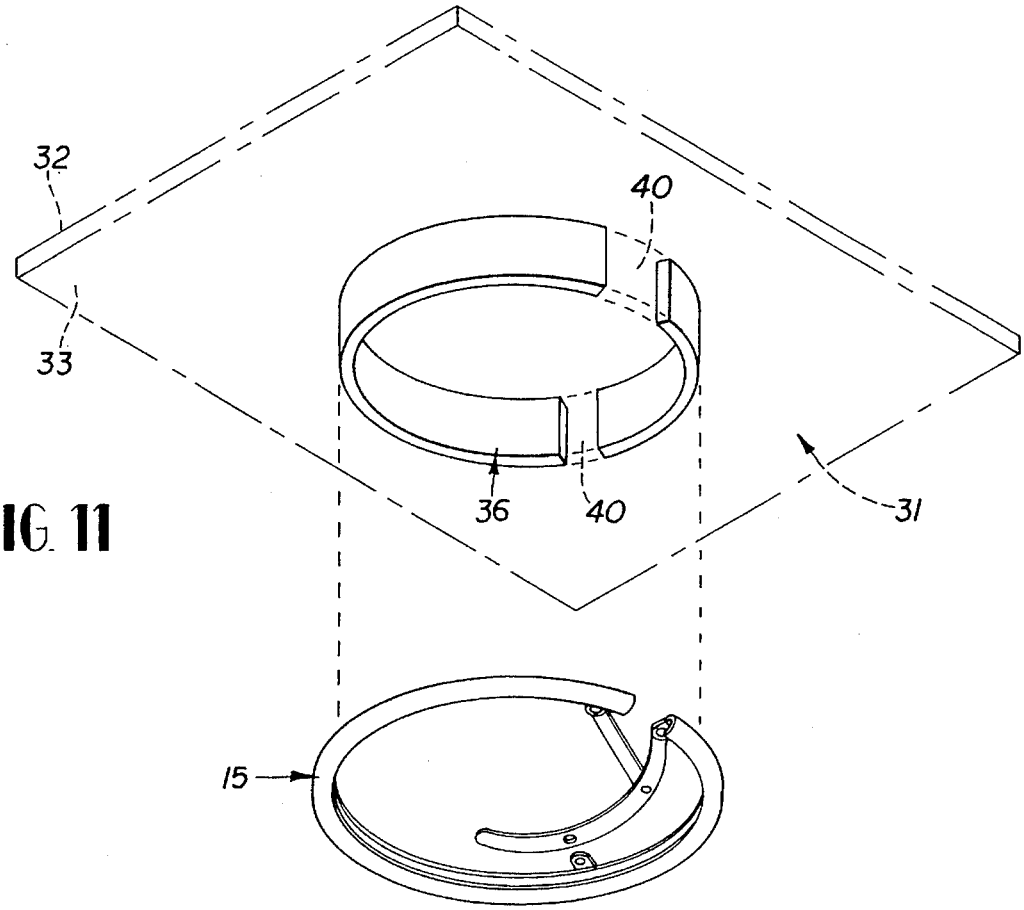
FIG. 11 is a bottom perspective view showing the apparatus configured for placement of a split closing ring with an inside lever-lock.
Figure 12:
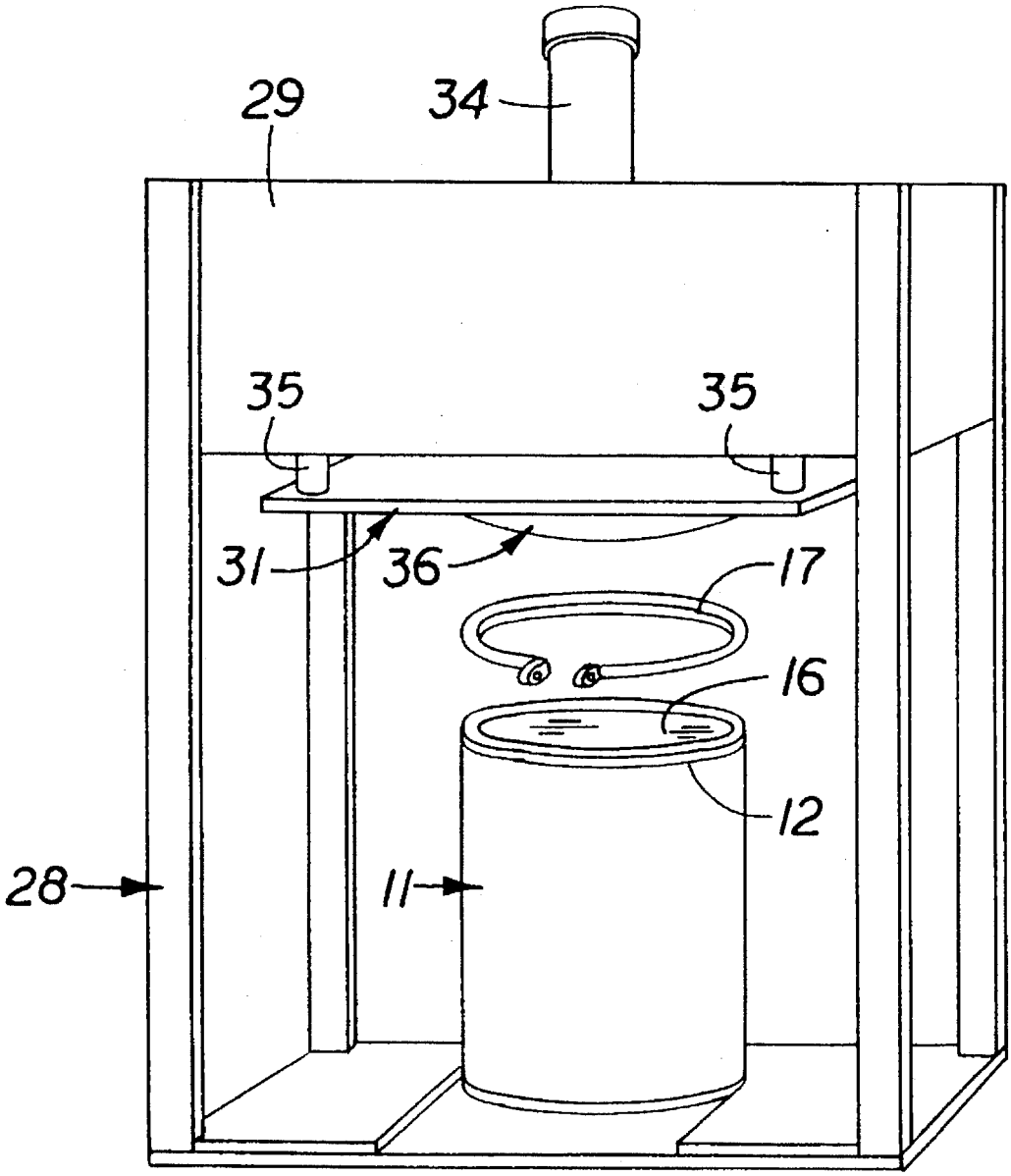
FIG. 12 is a perspective view of an alternate embodiment showing the apparatus mounted as a stand alone sealing press.

As shown in FIGS. 1–3, an open head drum 11 has an upper peripheral edge which is formed into a rolled rim 12. A compressible gasket 13 is placed between the rim 12 and a downwardly opening annular mating groove 14 formed in a lid 16. A split closing ring 17 having a first end 18, a second end 19, and a middle 20 is dimensioned to fit around the juncture between the drum and the lid. Fastening tabs 21, having apertures 22 defined therethrough, are affixed to each end of the split closing ring 17. After compression of the gasket 13 and proper placement of the split closing ring 17, the first end 18 and the second end 19 of the split closing ring 17 are joined together by means of a bolt 23 extending through the apertures 22. Although the present invention is described and depicted in terms of a split closing ring having ends fastened by a bolt, alternate closure means for split closing rings are known in the art and may be used with the present invention. An example of an alternate closure means is the lever latch ring disclosed in U.S. Pat. No. 5,284,270. Additionally, the present invention is designed for use with split closing rings having an inside lever-lock, as shown in FIG. 11.

In the preferred embodiment (See FIG. 1), the apparatus includes a roller-bar type conveyor 26. The conveyor includes a plurality of roller bars 27. The bars are operatively connected by means of a clutch to a drive motor 25, which causes each bar to rotate around its longitudinal axis, such that a drum placed on top of the roller bars will be conveyed in the direction of rotation of the bars. The apparatus includes a frame 28, having a top portion 29 positioned to hold a press plate 31 over the conveyor 26. As shown in FIG. 3, the press plate has an upper surface 32 and a lower surface 33. A fluid-activated press cylinder 34, preferably a pneumatic cylinder, is mounted to the top portion 29 of the frame 28, and is operatively connected to the upper surface 32 of the press plate 31, such that the press plate 31 is movable vertically in response to pressure from the cylinder 34. The press plate is slidably mounted by means of guide rods 35 extending through guide apertures 30 in the frame top portion 29.

Figure 5:
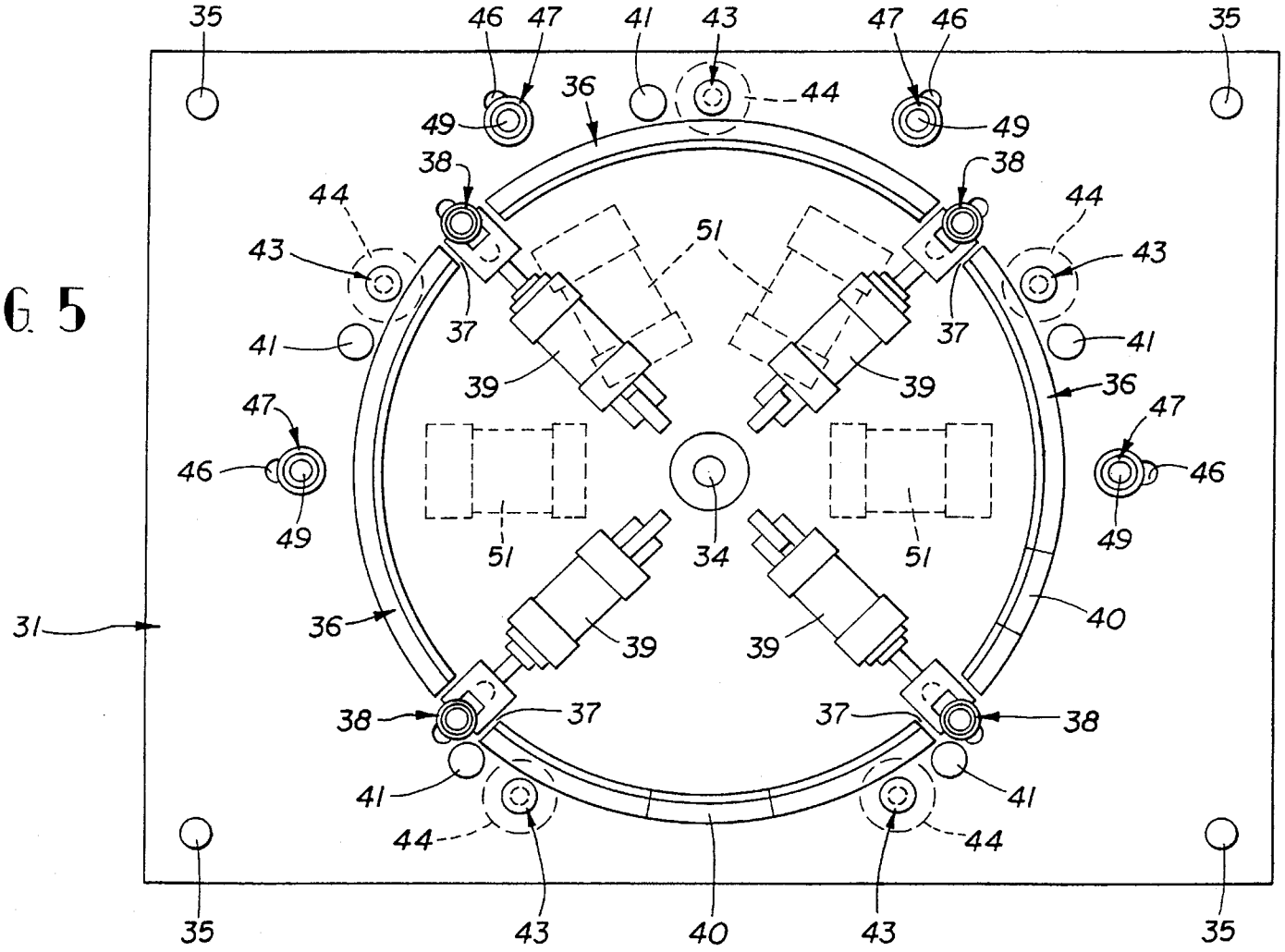
FIG. 5 is a bottom view of the press plate.
Figure 7:
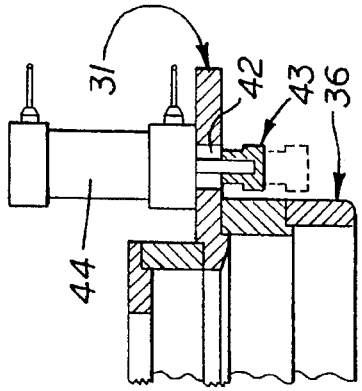
FIG. 7 is a sectional view of a pin and actuator, taken along line 7—7 of FIG. 4.
Figure 6:
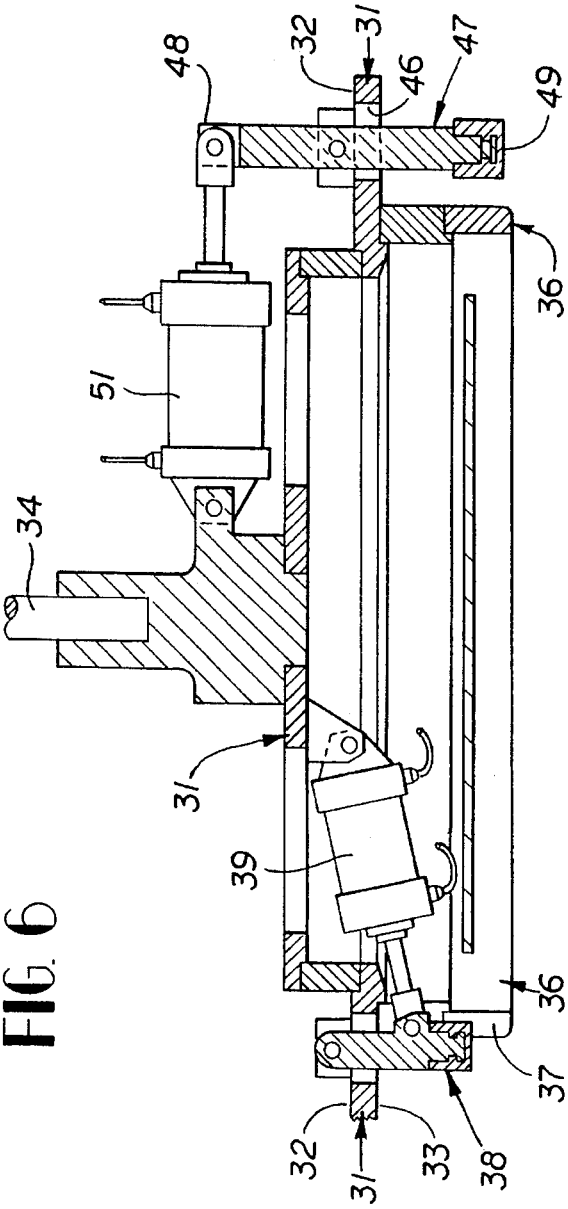
FIG. 6 is a sectional view of the press plate, taken along line 6—6 of FIG. 4 showing a closing ring expander and a clamp lever.
Figure 16:
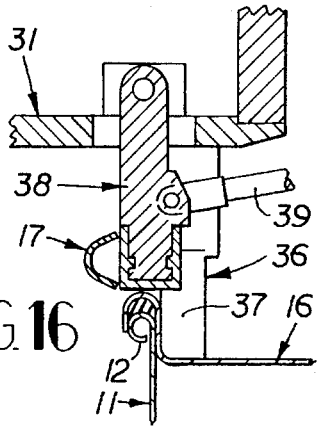
FIG. 16 is a sectional view of a closing ring expander in the extended position.

A press ring 36, dimensioned to fit on top of the lid 16, just inside of the mating groove 14, is rigidly affixed to the lower surface 33 of the press plate 31. The press ring 36 has selectively detachable segments 40 (FIG. 5), which must be removed to use the apparatus with the inside lever-lock type split closing ring 15, as shown in FIG. 11. The press ring 36 has a plurality of slots 37 defined through its wall and spaced about its circumference. As shown in FIGS. 5 and 16, a plurality of closing ring expanders 38 are pivotally mounted for lateral movement through each of the slots 37 in the press ring 36. Each closing ring expander 38 is operatively connected to an expander actuator 39, which is affixed to the lower surface 33 of the press plate 31, inside the circle defined by the press ring 36.

Figure 13:
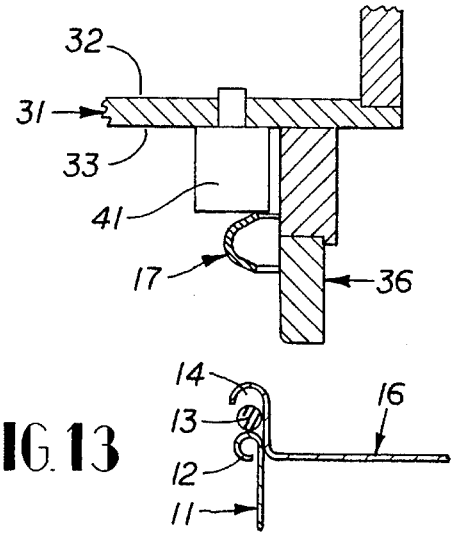
FIG. 13 is a sectional view of the press ring and magnet engaging a split closing ring.
Figure 14:
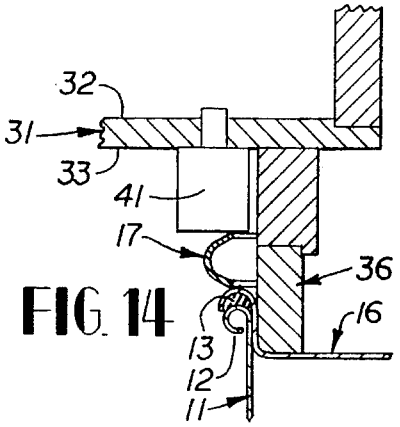
FIG. 14 is a sectional view of the press ring, magnet, and split closing ring engaging a drum.
Figure 15:
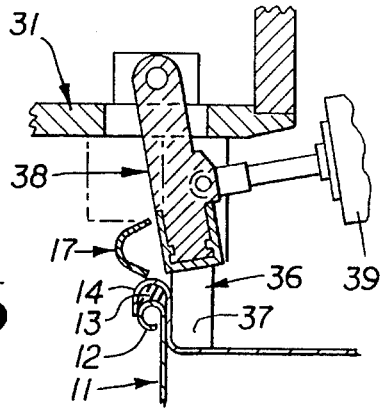
FIG. 15 is a sectional view of a closing ring expander in the retracted position.

A plurality of magnets 41 are mounted to the lower surface 33 of the press plate 31, outside of the press ring 36. The magnets 41 are positioned to hold a split closing ring 17 in a position encircling the press ring 36 (See FIGS. 5 AND 13).

Figure 17:
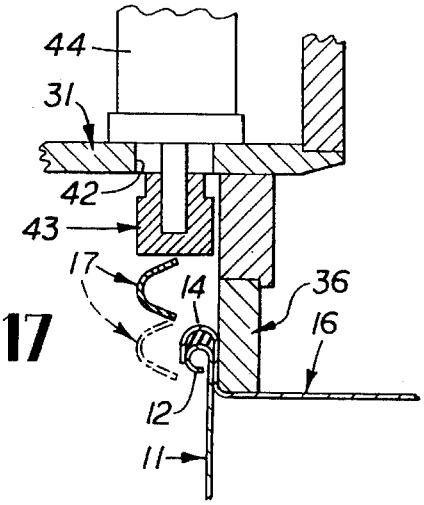
FIG. 17 is a sectional view of a pin and actuator positioning a split closing ring.
Figure 18:
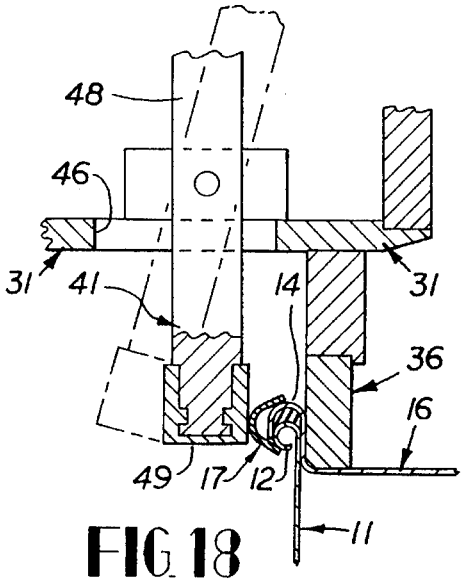
FIG. 18 is a sectional view of a clamp lever engaging a split closing ring about a drum.

As shown in FIGS. 5 and 17 the press plate 31 has a plurality of apertures 42, extending through the plate 31 from its upper surface 32 to its lower surface 33. The apertures 42 are positioned in a circle, overlying the position of the split closing ring 17 as it is held around the press ring 36 by the magnets 41. A plurality of pins 43, operatively connected to pin actuators 44 mounted to the upper surface 32 of the press plate 31, extend through the apertures 42. The pins 43 are divided into a first group, consisting of those pins positioned above the split closing ring 17 from the first end 18 of the split closing ring to about its middle 20. The second group of pins consists of the remaining pins 43 overlying the split closing ring 17.

Figure 4:
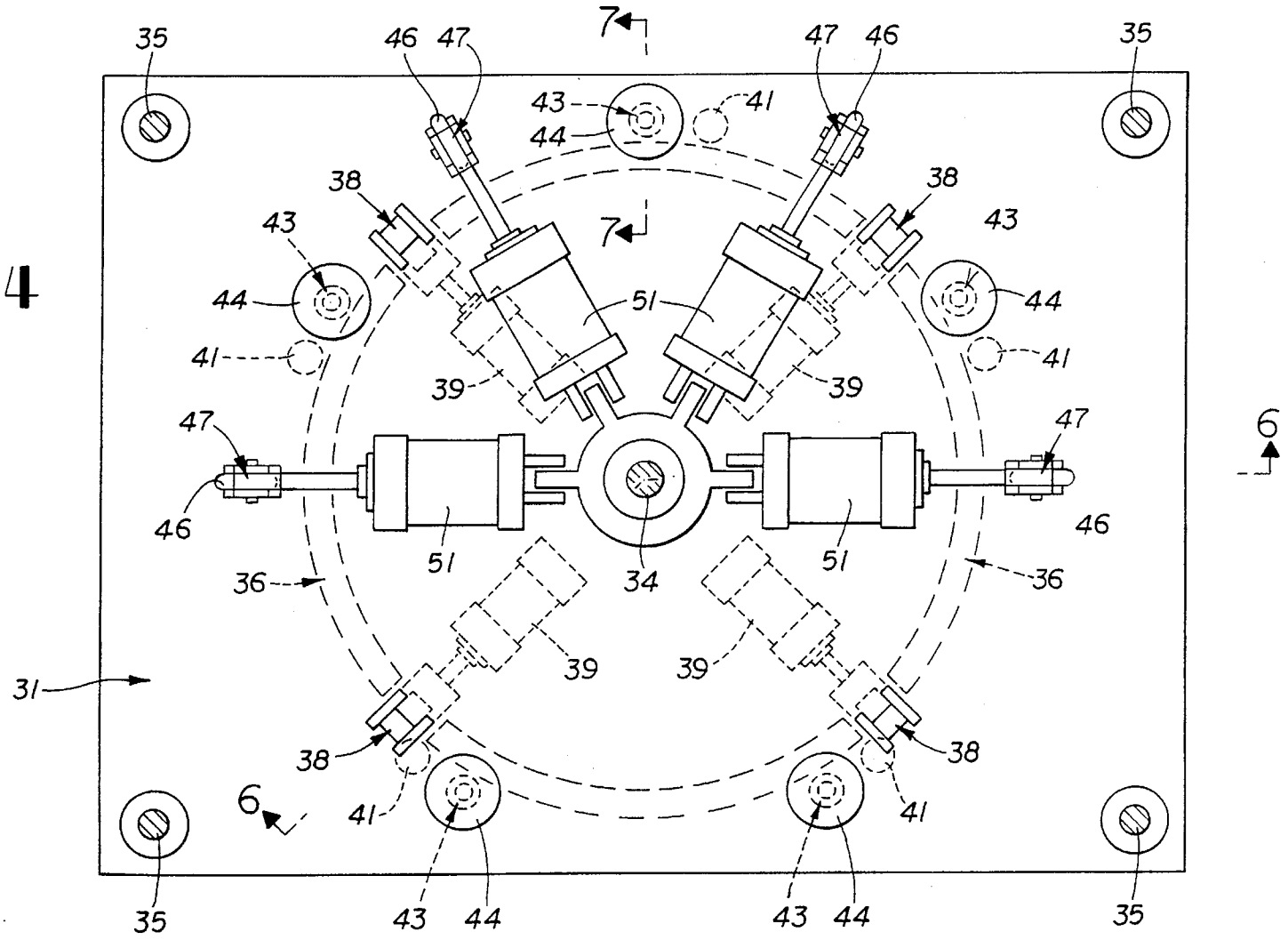
FIG. 4 is a top view of the press plate.

A set of clamp apertures 46 are defined through the press plate 31, positioned on the circle overlying the position of the split closing ring 17. A clamp lever 47, having a top end 48 and a bottom end 49, is pivotally mounted within each aperture 46, such that the bottom end 49 is positioned below the press plate 31, outside of the split closing ring 17, and the top end 48 is above the press plate 31. The top end 48 of each of the clamp levers 47 is pivotally connected to a clamp actuator 51 mounted on the upper surface 32 of the press plate 31 (See FIG. 4). The expander actuators 39, pin actuators 44, and the clamp actuators 51 are fluid-activated cylinders, preferably pneumatic.

Figure 10:
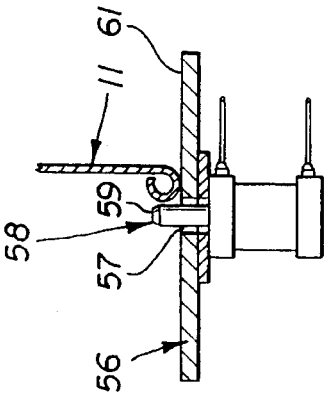
FIG. 10 is a sectional view showing a drum stop and actuator in the extended position.
Figure 9:
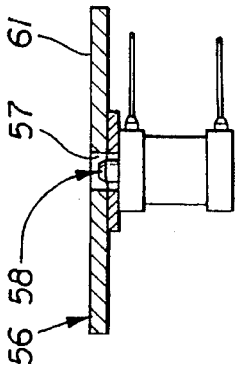
FIG. 9 is a sectional view taken along line 9—9 of FIG. 8 showing a drum stop and actuator in the retracted position.
Figure 8:
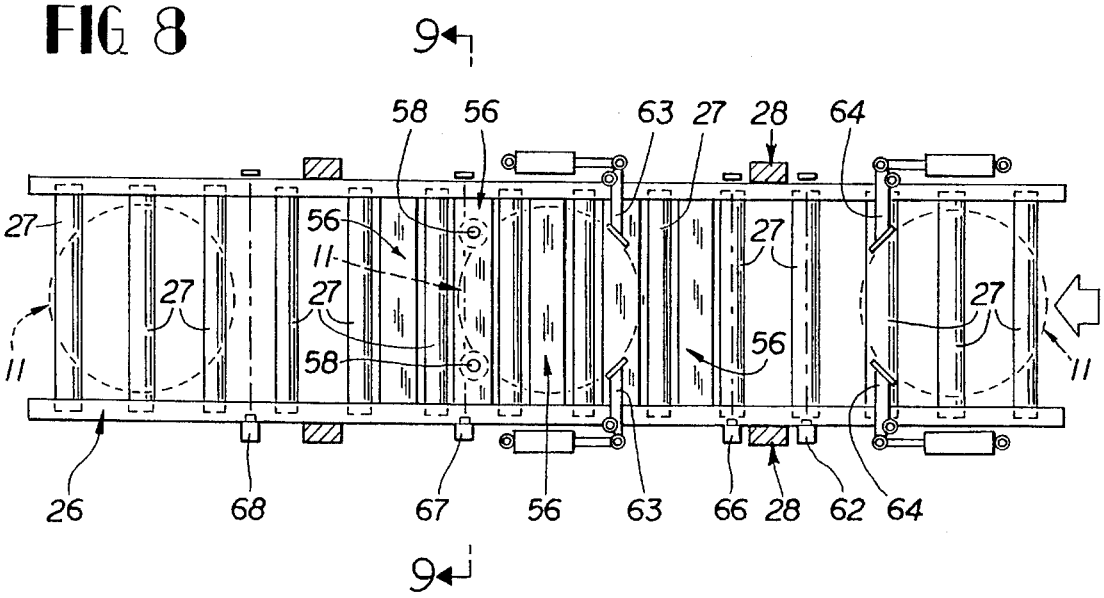
FIG. 8 is a sectional view of the roller bar conveyor, taken along line 8—8 of FIG. 1.

As shown in FIGS. 1 and 8, the area of the conveyor 26 generally positioned below the press plate 31 defines a sealing area 52 of the conveyor, having an entry side 53 and an exit side 54. The roller bars 27 positioned within the sealing area 52 of the conveyor are movable between a raised position, in which they are substantially level with the roller bars 27 on either side of the sealing area 52, and a lowered position, and are spring-biased in the raised position. A plurality of support members 56 are rigidly mounted to the conveyor 26 between the roller bars 27 in the sealing area 52. In the preferred embodiment, the support members 56 are elongated rectangular plates. Rods or bars could also be used for the support members. One of the support members proximal the exit side 54 of the sealing area 52 has a pair of apertures 57 defined therethrough. A pair of rod-shaped stops 58 are positioned within the apertures 57. (See FIGS. 9 and 10). The stops 58, movably affixed to a fluid actuator, have an upper segment 59, and are movable between an extended position, with the upper segment 59 protruding above the top surface 61 of the support member 56, and a retracted position, in which the entire stop 58 is below or level with the top surface 61 of the support member. Control signals for the apparatus may be incorporated in a ladder logic circuit, a computer, or a series of relays and switches which actuate the fluid actuators in response to a variety of signals. The stops 58 are controlled by a first sensor 62 (FIG. 8), preferably an optical sensor, mounted near the entry side 53 of the sealing area 52, such that it detects the movement of a drum 11 into the sealing area. The stops 58 rise to their extended position in response to a signal to the control circuit from the first sensor 62 that a drum 11 is entering the sealing area 52. A pair of positioning arms 63, also fluid driven, are pivotally mounted to the frame 28 on opposite sides of the conveyor 26 proximal the entry side 53 of the sealing area 52. The positioning arms 63 are mounted so that they pivot into position behind the drum 11, urging it against the stops 58. The movement of these arms is also electrically controlled.

A pair of escapement arms 64 are pivotally mounted on opposite sides of the conveyor 26 at a position upstream from the entry side 53 of the sealing area 52. The escapement arms 64 are movable between an open position, in which they pose no impediment to an advancing drum 11, and a closed position, in which they will prevent a drum 11 from advancing along the conveyor 26 toward the sealing area 52. A second sensor 66, also an optical sensor in the preferred embodiment, is positioned near the first sensor 62 proximal the entry side 53 of the sealing area 52. The escapement arms 64 are actuated and move to their closed position in response to a signal from the second sensor 66 that a drum 11 has moved into the sealing area 52 of the conveyor 26.

A third optical sensor 67 is mounted along the conveyor 26 at a position proximal the exit side 54 of the sealing area 52, such that it can detect when a drum 11 has moved into a position adjacent the stops 58. The third sensor 67 provides control signals for the press cylinder 34, allowing the press plate 31 to begin its descent, and to a clutch brake mechanism (not shown), which stops the rotation of the roller bars 27.

A fourth sensor 68 is mounted along the conveyor 26 at a position downstream from the exit side 54 of the sealing area 52 to detect when the drum 11 has moved out of the sealing area 52. The fourth sensor 68 signals escapement arms 64 to move to their open position so that the next drum 11 can move into the sealing area 52.

A first safety shield 69 and a second safety shield (not shown) are slidably mounted to the top portion 29 of the frame 28 by means of shield guide rods 73. The shields are connected to first and second shield actuators 72. It will be appreciated that the present embodiment uses fluid driven actuators; however, it is within the scope of the invention to substitute other drive elements, such as electrical motors and drives, for such actuators.

Release switches 74 are in electrical control of the stops 58 and the clutch, such that activation of the switch causes the stops move to their retracted position and the roller bars to resume rotation, moving the sealed drum 11 away from the sealing area 52.

The apparatus may be operated in either a single-worker or a two-worker mode. In the single-worker mode, the apparatus works as follows. Drive motor 25 is activated, causing the roller bars 27 to rotate. A drum 11, having a sealing gasket 13 and a lid 16 in place, is placed on the conveyor 26 and travels in the direction of rotation of the roller bars 27 toward the sealing area 52. Assuming that the sealing area 52 is clear, the drum 11 proceeds past the open escapement arms 64 toward the sealing area 52. As it passes the first optical sensor 62, the stops 58 are pushed upwardly through the apertures 57 in the support member 56 to their extended position, such that the upper segments 59 of the stops 58 protrude above the top surface 61 of the support member 56. As the drum 11 passes the second optical sensor 66, the escapement arms 64 move to their closed position, preventing advancement of a second drum into the sealing area 52. As the drum 11 is sensed by the third optical sensor 67, the positioning arms 63 close behind the drum 11, urging it against the stops 58, and the clutch disengages the drive motor 25 from the roller bars 27, such that the roller bars 27 cease their rotation. The worker places the split closing ring 17 in position against the magnets 41 either before the drum 11 travels into the sealing area 52 or after the drum 11 is in position for sealing. The worker depresses the front activation switches 76, which causes the first safety shield 69 to lower, and the press cylinder 34 to actuate the press plate 31 to move downwardly toward the lid 16 of the drum 11. As the press plate 31 descends, the closing ring expanders 38 are actuated, expanding the split closing ring. The press ring 36 urges the lid 16 downwardly, compressing the gasket 13. As the press ring 36 exerts downward pressure on the drum 11, the spring-biased roller bars 27 in the sealing area 52 are moved to their lowered position, such that the support members 56 bear the compressive force. The first group of pins 43, consisting of those pins positioned above the split closing ring 17 from the first end 18 of the split closing ring to about its middle 20, are actuated, urging the first end 18 of the split closing ring 17 and the side of the closing ring proximal the first end 18 away from the magnets 41 and into position along the juncture between the lid 16 and the drum 11. The second group of pins 43, consisting of the remaining pins, urges the other side of the ring proximal the second end 19 of the split closing ring 17 downwardly away from the magnets 41 and into position along the juncture between the lid 16 and the drum 11. The clamp levers 47 are then actuated, pressing the closing ring 17 against the lid 16 and drum 11 and forcing the first end 18 and second end 19 of the split closing ring 17 toward each other. The first safety shield 69 is then raised, allowing the worker to connect the first end 18 and second end 19 of the split closing ring 17 with a bolt 23. The worker then actuates the release switches 74, which causes the clamp levers 47 to release, the press plate 31 to raise, the stops 58 to retract, and the roller bars 27 to move to their raised position and resume rotation, moving the drum 11 out of the sealing area 52.

When a second worker is assisting with the sealing process, the second worker is positioned on the back side 77 of the apparatus, near the second safety shield, and the first worker is positioned on the front side 78 of the apparatus, near the first safety shield 69. The apparatus operates as stated above, except that prior to the drum 11 entering the sealing area 52, the second safety shield is in a raised position. The first safety shield 69 is in a lowered position. The worker on the back side 77 places the split closing ring 17 in position against the magnets 41, then presses rear activation switches (not shown) to lower the shield. Instead of activating the press cylinder 34 by pressing the front activation switches 76, the press cylinder 34 is activated by the signal from the third sensor 67 indicating that the drum 11 is in position. After the split closing ring 17 is in position, the first safety shield 69 moves to a raised position so that the first worker can install the bolt 23. After the bolt 23 is tightened, the first worker depresses the release switches 74.

While I have shown my invention in one form, it will be obvious to those skilled in the art that it is not so limited but is susceptible of various changes and modifications without departing from the spirit thereof.

Having set forth the nature of my invention, what I claim is:

1. An apparatus for positioning and compressing the sealing components of an open-head drum having a detachable lid, said drum having an upper rolled rim and said lid having a perimeter and a mating groove positioned along said perimeter, said mating groove dimensioned to fit on said rim of said drum, said mating groove positioned on said rim, forming a juncture between said lid and said drum, said sealing components including a compressible gasket positioned between said mating groove of said lid and said rim of said drum, and a split closing ring having a first end and a second end, comprising:

(a) means for holding said split closing ring superjacent said drum and said lid;

(b) means for urging said lid downwardly such that said gasket is compressed;

(c) means for expanding said split closing ring; and (d) means for sequentially urging said split closing ring, from said first end to said second end of said split closing ring, into a position circumscribing said juncture between said drum and said lid.

2. An apparatus as defined in claim 1, further comprising a frame, having a top portion, and wherein said means for urging said lid downwardly comprises:

(a) a press cylinder, mounted to said top portion of said frame;

(b) a press plate, operatively connected to said press cylinder for vertical movement relative to said press cylinder, said press plate having an upper surface and a lower surface; and (c) a press ring, affixed to said lower surface of said press plate, said press ring having a wall and a plurality of slots defined through said wall, said slots spaced about the circumference of said press ring.

3. An apparatus as defined in claim 2, wherein said split closing ring expanding means comprises:

(a) a plurality of closing ring expanders, pivotally mounted for lateral movement through said plurality of slots in said wall of said press ring; and (b) a plurality of expander actuators, mounted to said lower surface of said press plate, adjacent and operatively connected to said closing ring expanders.

4. An apparatus as defined in claim 2, wherein said means for holding said split closing ring comprises at least one magnet, affixed to the lower surface of said press plate externally of and adjacent said press ring, such that said split closing ring is held in a position encircling said press ring.

5. An apparatus as defined in claim 2, wherein said split closing ring further has a middle and a first side extending from said first end of said split closing ring to its middle, and a second side extending from said middle of said split closing ring to said second end of said split closing ring, and wherein said press plate further has a plurality of apertures defined therethrough, and said apertures positioned in and defining a circle overlying said encircling position of said split closing ring, and wherein said means for sequentially urging said split closing ring into a position circumscribing said juncture between said drum and said lid comprises:

(a) a plurality of pins, extending through said apertures, said pins being movable between an extended position and a retracted position, said plurality of pins divided into a first group and a second group, said first group positioned above said first side of said split closing ring and said second group positioned above said second side of said split closing ring; and (b) means for sequentially actuating said first and second groups of pins, such that said first group of pins is moved to said extended position before said second group is moved to said extended position.

6. An apparatus as defined in claim 5, further comprising means for compressing said closing ring into abutment with said drum and said lid at said juncture, such that said first and second ends of said split closing ring may be fastened together.

7. An apparatus as defined in claim 5, wherein said press plate further has a plurality of clamp apertures defined therethrough, and wherein said closing ring compressing means comprises:

(a) a plurality of clamp levers, each having a top end and a bottom end, said clamp levers extending through said clamp apertures and pivotally mounted to said press plate such that said bottom end of said clamp levers are positioned adjacent and external to said split closing ring;

(b) a plurality of clamp actuators, affixed to the upper surface of said press plate and pivotally connected to the top ends of said plurality of clamp levers.

8. An apparatus as defined in claim 7, further comprising a roller-bar conveyor, upon which said drum is conveyed, said conveyor positioned such that said drum passes beneath said press plate, said roller-bar conveyor comprising a plurality of roller bars, each of said roller bars mounted to said conveyor for rotation about the longitudinal axis of said roller bar.

9. An apparatus as defined in claim 8, wherein said roller-bar conveyor comprises a plurality of spring-biased roller bars positioned below said press plate, said roller bars positioned at intervals along said conveyor, defining spaces therebetween, said spring-biased roller bars movable between a raised position and a lowered position, said roller bars being spring-biased in said raised position.

10. An apparatus as defined in claim 9, wherein each of said spring-biased roller bars further has an upper edge, said apparatus further comprising a plurality of elongated support members, affixed to said frame in said spaces intermediate said plurality of spring-biased roller bars, said support members positioned at a level relative to said spring-biased roller bars such that said support members are below the level of said upper edges of said spring-biased roller bars when said roller bars are in said raised position, and such that said support members are at a level substantially even with the level of said upper edges of said spring-biased roller bars when said roller bars are in said lowered position.

11. An apparatus as defined in claim 10, wherein said spring-biased roller bars and said elongated support members define a sealing area of said conveyor, said sealing area having an entry side and an exit side, and wherein a plurality of said drums are transported simultaneously along said conveyor, further comprising means for preventing a second of said plurality of drums from advancing into said sealing area of said conveyor while a first of said plurality of drums is positioned on said sealing area.

12. An apparatus as defined in claim 8, further comprising means for aligning said drum in a position for sealing.

13. An apparatus as defined in claim 12, further comprising means for releasing said second of said plurality of drums for advancement into said sealing area after said first of said plurality of drums has been conveyed from said sealing area.

14. An apparatus as defined in claim 11, wherein one of said plurality of support members, proximal said exit side of said sealing area, comprises a rectangular plate having a first and second end, a first aperture through said plate proximal said first end, a second aperture through said plate proximal said second end, and a top surface, and wherein said drum aligning means comprises:

(a) a first stop, having an upper segment, said first stop positioned for vertical movement through said first aperture, said first stop movable between an extended position wherein said upper segment of said first stop extends through said first aperture and above said top surface of said plate, and a retracted position wherein said upper segment of said first stop does not extend above said top surface of said plate;

(b) a second stop, having an upper segment, said second stop positioned for vertical movement through said second aperture, said second stop movable between an extended position wherein said upper segment of said second stop extends through said second aperture and above said top surface of said plate, and a retracted position wherein said upper segment of said second stop does not extend above said top surface of said plate; and (c) a first sensor, mounted proximal said entry side of said sealing area, for detecting the presence of a drum and outputting a signal responsive thereto, such that said first and second stops move to said extended position in response to said signal from said first sensor;

(d) a pair of positioning arms, pivotally mounted proximal said entry side of said sealing area on opposing sides of said conveyor; and (e) means for urging said positioning arms against one of said drums in said sealing area, such that said drum is urged against said stops.

15. An apparatus as defined in claim 13, wherein said means for preventing advancement of said second of said plurality of drums into said sealing area comprises:

(a) a second sensor, positioned proximal said entry side of said sealing area for detecting the presence of a drum and outputting a signal responsive thereto; and (b) a pair of escapement arms, pivotally mounted on opposing sides of said conveyor at a position spaced from said entry side of said sealing area, said pair of escapement arms movable between an open position and a closed position, such that said escapement arms move to said closed position in response to said signal from said second sensor.

16. An apparatus as defined in claim 15, further comprising means for stopping said roller bars from rotating when one of said plurality of drums is in said sealing position.

17. An apparatus as defined in claim 16, further comprising means for sequentially activating said lid-urging means, said closing ring-expanding means, said split closing ring sequential urging means and said closing ring compression means when one of said plurality of drums is in said sealing position.

18. An apparatus as defined in claim 17, further comprising means for detecting when one of said plurality of drums is in said position for sealing.

19. An apparatus as defined in claim 18, wherein said detection means comprises a third sensor mounted proximal said exit side of said sealing area.

20. An apparatus as defined in claim 19, wherein said means for releasing said second of said plurality of drums for advancement into said sealing area comprises a fourth sensor, mounted along said conveyor at a position spaced from said exit side of sealing area to detect a drum thereat, said fourth sensor operably connected, such that said escapement arms move to said open position in response to a signal from said fourth sensor.

21. An apparatus as defined in claim 20, wherein said split closing ring has an inside lever-lock, and wherein said press ring further comprises a plurality of selectively detachable segments positioned such that said press ring may engage said lid without engaging said split closing ring.

22. An apparatus for positioning and compressing the sealing components of an open-head drum, said drum having a rim and said sealing components including a lid, having a mating groove dimensioned to fit over said rim such that a juncture is defined between said lid and said drum, a compressible sealing gasket positioned between said rim and said mating groove, and a split closing ring, said split closing ring having a first end and a second end, comprising:

(a) means for aligning said drum in a position for receiving said split closing ring;

(b) means for urging said lid toward said rim such that said gasket is compressed;

(c) magnetic means for holding said split closing ring above and in alignment with said lid;

(d) means for expanding said split closing ring such that the diameter of said split closing ring exceeds that of said lid;

(e) means for sequentially urging said split closing ring, from said first end to said second end, into a position circumscribing said juncture between said lid and said drum;

(f) means for compressing said split closing ring against said juncture between said lid and said drum such that said first and second ends of said split closing ring may be fastened together;

(g) means for sequentially activating said closing ring-expanding means, said lid-urging means, said sequential closing ring-urging means and said closing ring-compressing means.

23. An apparatus as defined in claim 22, further comprising a frame having a base portion and a top portion, and wherein said lid-urging means comprises:

(a) a press cylinder, mounted to said top portion of said frame;

(b) a press plate, subjacent and operatively connected to said press cylinder for vertical movement relative thereto, said press plate having an upper surface and a lower surface; and (c) a press ring, said press ring affixed to the lower surface of said press plate.

24. An apparatus as defined in claim 23, wherein said press ring has a wall defining its circumference, said wall having a plurality of slots defined therethrough, said slots spaced about said circumference of said press ring, and wherein said closing ring-expanding means comprises:

(a) a plurality of expander actuator cylinders, each of said expander actuator cylinders mounted to said lower surface of said press plate adjacent one of said slots;

(b) a plurality of closing ring expanders, each of said expanders pivotally mounted within one of said slots for lateral movement therethrough, said expanders operatively connected to one of said plurality of expander actuator cylinders.

25. An apparatus as defined in claim 22, wherein said split closing ring is held subjacent said lower surface of such press plate by said magnetic holding means, defining a circular split closing ring position having a first side proximal said first end of said split closing ring and a second side proximal said second end of said split closing ring, and wherein said press plate further has a plurality of pin apertures therethrough, said pin apertures positioned on and spaced about said circular split closing ring position, and wherein said sequential closing ring-urging means comprises:

(a) a plurality of pins, each of said pins extending through one of said plurality of pin apertures, said plurality of pins divided into a first set, positioned in said pin apertures along said first side of said split closing ring position, and a second set, positioned in said pin apertures along said second side of said split closing ring position; and (b) a plurality of pin actuators, mounted to said upper surface of said press plate, said pin actuators divided into a first group, operatively connected to said first set of pins, and a second group, operatively connected to said second set of pins.

26. An apparatus as defined in claim 22, wherein said press plate further has a plurality of clamp apertures therethrough, said clamp apertures positioned on and spaced about said circular split closing ring position, and wherein said closing ring-compressing means comprises:

(a) a plurality of clamp levers, each having a top end and a bottom end, each of said clamp levers extending through and pivotally mounted within one of said plurality of clamp apertures, said bottom ends of said clamp levers positioned laterally of said split closing ring position; and (b) a plurality of clamp actuators, mounted to said upper surface of said press plate, each of said clamp actuators pivotally connected to said top end of one of said clamp levers.

27. An apparatus as defined in claim 23, wherein said base portion of said frame comprises a base platform, said base platform having an upper surface, and wherein said drum aligning means comprises an index, defined in said upper surface of said base platform.

28. An apparatus as defined in claim 26, wherein said activating means comprises an electrical switch mounted to said frame, and operably connected to actuate said expander actuator cylinders, said first group of said pin actuators, said second group of pin actuators and said clamp actuators.

29. An apparatus as defined in claim 23, wherein said frame is positioned along a roller-bar conveyor, said conveyor having a plurality of roller bars, said roller bars spaced apart such that spaces are defined therebetween, said conveyor further having a sealing area positioned below said press plate, said sealing area having an entry side and an exit side, further comprising a plurality of elongated support members, positioned within said spaces intermediate said roller bars in said sealing area of said conveyor.

30. An apparatus as defined in claim 29, wherein said roller bars in said sealing area of said conveyor are movable between a raised position and a lowered position, said roller bars being spring-biased in said raised position.

31. An apparatus as defined in claim 29, wherein one of said elongated support members proximal said exit side of said sealing area comprises a rectangular plate, said plate having a pair of spaced apertures defined therethrough, and wherein said drum aligning means comprises:

(a) a sensor, positioned proximal said entry side of said sealing area, for detecting when a drum is entering said sealing area;

(b) a pair of stops, each positioned within one of said apertures in said rectangular plate, said stops movable between an extended position above said plate and a retracted position, said stops responsive to said sensor such that said stops move from said retracted position to said extended position responsive to a signal from said sensor.

* * * * *